United States Patent [19]

Schmidt

[11] Patent Number: 4,744,108

[45] Date of Patent: May 17, 1988

[54] BATHTUB DRAIN APPARATUS

[75] Inventor: Erwin Schmidt, Kenosha, Wis.

[73] Assignee: Frost Company, Kenosha, Wis.

[21] Appl. No.: 13,938

[22] Filed: Feb. 12, 1987

[51] Int. Cl.[4] ..... E03C 1/24; E03C 1/22

[52] U.S. Cl. ..... 4/199; 4/198; 4/204

[58] Field of Search ..... 4/199, 198, 204, 206

[56] References Cited

U.S. PATENT DOCUMENTS

| | | | |
|---|---|---|---|
| 1,704,510 | 3/1929 | Muend | 4/203 |
| 1,745,002 | 1/1930 | Brotz | 4/197 |
| 1,807,117 | 5/1931 | Kaufman | 4/199 |
| 1,867,725 | 7/1932 | Brotz | 4/199 |
| 1,909,852 | 5/1933 | Anderson | 4/203 |
| 1,931,568 | 10/1933 | Brotz | 4/204 |
| 1,937,312 | 11/1933 | Brotz | 4/199 |
| 1,943,628 | 1/1934 | Schultis | 4/199 |
| 2,052,565 | 9/1936 | Groeniger | 4/199 |
| 2,059,120 | 10/1936 | Kreuzar et al. | 4/199 |
| 2,268,819 | 1/1942 | Groeniger | 4/199 |
| 2,271,837 | 2/1942 | Fredrickson et al. | 4/199 |
| 2,607,045 | 8/1952 | Morris | 4/199 |
| 2,706,298 | 4/1955 | Holycross, Jr. | 4/199 |
| 2,859,453 | 11/1958 | Bloch | 4/199 |
| 2,871,487 | 2/1959 | Fife | 4/199 |
| 2,910,704 | 11/1959 | Kinsey et al. | 4/199 |
| 3,121,879 | 2/1964 | Young | 4/198 |
| 3,493,978 | 2/1970 | Hindman et al. | 4/198 |
| 3,835,484 | 9/1974 | Kato | 4/199 |
| 3,855,648 | 12/1974 | Dunham | 4/199 |
| 3,860,977 | 1/1975 | Politz | 4/199 |
| 4,085,469 | 4/1978 | Petursson | 4/199 |
| 4,089,230 | 5/1978 | Nelson | 74/97 |
| 4,194,252 | 3/1980 | Tsuei | 4/199 |
| 4,352,213 | 10/1982 | Watts | 4/199 |
| 4,594,738 | 6/1986 | Gebert | 4/199 |

*Primary Examiner*—Henry K. Artis

*Attorney, Agent, or Firm*—Peter N. Jansson, Ltd.

[57] ABSTRACT

A bathtub drain having a fixed body at the tub overflow opening a rotational member extending through the fixed body and having a rear portion behind the fixed body, a non-axially positioned linkage attachment point on the rear portion of the rotational member, and a pair of contact surfaces on the fixed body and rotational member and biased together, with different engagement characteristics marking different rotational positions of the rotational member. In preferred embodiments, the contact surfaces are the rearward surface of the fixed body and the forward surface of the rotational member rear portion, and these surfaces preferably have a groove and mating ridge to mark the fully open and closed positions.

18 Claims, 2 Drawing Sheets

BATHTUB DRAIN APPARATUS

FIELD OF THE INVENTION

This invention is related generally to bathtub drain apparatus and, more particularly, to bathtub drain control mechanisms of the type mountable at the bathtub overflow opening.

BACKGROUND OF THE INVENTION

Conventional bathtubs and similar containers are provided with two drain openings. The first drain opening is located at the bottom of the tub, while the second opening is located in a sidewall of the tub at a position near the first opening and just below the top of the tub wall. The first drain opening is the main drain opening while the second is an overflow opening.

Various devices, referred to as bathtub wastes, waste apparatus, drains or drain apparatus, are used to receive and control the flow of wastewater through such openings. Many prior devices include a control mechanism at the overflow opening and linkages extending from the control mechanism to allow such mechanism to operate a drain plug either at the main drain opening or in the drain pipe in position to block drainage. This invention relates to devices of this general type.

Prior devices of this type are of two general types: those having a lever which swings toward and away from the bathtub wall (or up and down) to lower or raise the drain plug through suitable linkage; and those having control levers or knobs which are rotated about an axis which intersects the tub wall to open and close the drain. Both types of devices have a number of operational problems and shortcomings.

For example, many of both types of such control devices are frequently difficult to maintain in place. That is, such control devices too easily move away from the intended positions—in which their drain plugs are either fully open or fully closed. Such problems of "creep" or "wandering" can cause unintended drainage when occlusion is desired and/or insufficient drainage when drainage is desired.

Certain control mechanisms for mounting at the overflow opening must be rotated only in one direction to close and the other direction to open the drain. In some cases, this can make the operation of the device more difficult to understand. Furthermore, in such devices the rotating elements are quite prone to wander or creep away from the desired fully open or fully closed position.

In some cases drain mechanisms tend to move too easily away from the proper control position because of an unintended application of force. For example, when a drain plug is in the raised (open) position, it can too easily be moved away from such open position when the drain plug is stepped on, for example, by someone standing in the bathtub for a shower.

Another problem in some prior art devices of the type having a rotationally operated control mechanism is that it is sometimes rather difficult to determine just where the fully open position and fully closed position may be. This is particularly the case for rotational control devices having control knobs which may be rotated in either direction to achieve the desired condition.

Both swinging control levers and rotating control levers and knobs typically form fairly sharp projections or irregular surfaces extending well away from the wall of the tub. These tend to be a nuisance for a person leaning or wanting to lean against the wall of the tub.

Furthermore, such swinging levers and other sharply projecting knobs and levers tend to provide a site for splashing of water discharged into the tub from the tub filling spout above. Many people consider this a nuisance.

Another problem with certain rotatable control knobs is that they are difficult to operate. Insufficient leverage is available for easy operation. This problem is acute for people with no strength in their fingers and people without fingers.

For all of these and other reasons, there is a need for an improved bathtub drain apparatus. In particular, there is a need for an improved rotary bathtub drain control mechanism of the type mountable at the bathtub overflow opening.

OBJECTS OF THE INVENTION

It is an object of this invention to provide an improved bathtub drain apparatus overcoming some of the problems and shortcomings of the prior art, including those set forth above.

Another object of this invention is to provide a bathtub drain apparatus which is more easily operated than certain devices of the prior art.

Another object of this invention is to provide an improved control mechanism for bathtub drain apparatus.

Another object of this invention is to provide a bathtub drain control mechanism which provides a good indication of the fully open and fully closed positions.

Yet another object of this invention is to provide a bathtub drain control mechanism which does not wander or creep from the intended fully open or fully closed position during use.

Another object of this invention is to provide a control mechanism for a bathtub drain apparatus which remains fully open even when the drain plug is depressed by someone's foot.

Another object of this invention is to provide a rotary bathtub drain control mechanism which may be operated by rotation of a control knob in either direction with equal ease.

Still another object of this invention is to provide a bathtub drain control mechanism which is substantially smooth such that it can be leaned upon without discomfort.

These and other important objects will be apparent from the descriptions of this invention which follow.

SUMMARY OF THE INVENTION

This invention is a bathtub drain apparatus with an improved rotary control mechanism for mounting at the bathtub overflow opening. The apparatus of this invention overcomes certain problems and drawbacks of prior devices, including those mentioned above.

The bathtub drain rotary control mechanism of this invention includes a fixed body which forms a cavity extending through it from a front opening to a back opening, and means for securing the fixed body to the tub at the overflow opening. A rotational member extends in axial alignment through the cavity. The rotational member has a rear portion behind the back opening of the fixed body and a forward portion in front of the front opening of the fixed body. The rotational position of the rotational member within the fixed body determines whether water will drain from the tub through the main drain opening.

A control knob is secured to the forward portion of the rotational member. By turning the control knob in either direction, the control mechanism can be moved to either the fully open position or the fully closed position.

The rear portion of the rotational member has a linkage attachment means on it which is located in a non-axial position such that rotation of the rotational member imparts vertical motion to the linkage. The vertical motion of the linkage in turn controls the drain in known manner.

First and second contact surfaces on the fixed body and rotational member, respectively, which are in contact one with the other, have different engagement characteristics depending upon the rotational position of the rotational member with respect to the fixed body. Such different engagement characteristics provide a strong indication of the fully open and fully closed positions to the operator of the control mechanism.

In certain highly perferred embodiments, the fixed body has a rearward surface at its back opening forming the first contact surface, and the rear portion of the rotational member has a forward surface forming the second contact surface. Such forward surface of the rear portion of the rotational member is in camming engagement with the rearward surface of the fixed member. In different rotational positions, the characteristics of such engagement differ.

In certain highly preferred embodiments, one of the two engaging surfaces is a radially-oriented female groove while the other engaging surface is a radially-oriented male ridge which is engageable with the groove. The ridge is engaged in the groove only when the rotational position of the rotational member within the fixed member is such that the control mechanism is in either the fully open or fully closed position. In the most highly preferred embodiments, the rearward surface has the radially-oriented female groove while the forward surface has the radially-oriented male ridge.

When the rotational member is rotated from the fully closed or fully open position, in which the ridge is engaged in the groove, the ridge will move out of the groove and then turn freely until it drops back into the groove again after rotation of about 180 degrees. The movement of the ridge into the groove indicates the fully open and fully closed positions, and the engagement of ridge and groove prevents wandering from such positions.

In the fully open and fully closed positions, the rotational member has been rotated such that the linkage attachment means on the rear portion thereof is in either its lowermost position or its uppermost position. Which of these two positions corresponds to fully open and which to fully closed are dependent on the type of drain plug and how the linkage operates.

In one form, when the linkage attachment means on the rear portion of the rotational member is in its lowermost position, the drain plug will be fully open. In such position, the linkage, which extends through a standpipe, depresses a lever arm within a lateral drain pipe to lift the drain plug. Such linkage below the point of attachment to the rotational member functions in a manner known in the art.

When the rotational member has been rotated such that the linkage attachment is in its uppermost position, the drain will be fully closed. This occurs by the raising of the vertical linkage to release the lever arm, thus allowing the drain plug to move to the closed position. The lowermost and uppermost positions of the linkage attachment means can provide fully open and fully closed positions in other ways as well.

Furthermore, since the linkage attachment means is in its lowermost or uppermost position when the ridge and groove are engaged, vertical motion imparted to the linkage, such as by stepping on the drain plug, will not cause further rotational movement of the rotational member. This is because the linkage is attached at or near a "dead center" position, such that vertical force has no effect in causing unwanted rotation.

The rotational member of the rotary bathtub drain control mechanism of this invention may be rotated any amount in either direction to move the control mechanism to or from the fully open or fully closed position. It may be operated with equal ease in either the clockwise or the counter-clockwise direction.

Preferred embodiments include means biasing the first and second contact surfaces together to enhance effectiveness of their contact in marking different rotational positions of the rotational member with respect to the fixed body. The biasing means is preferably a spring within the cavity.

In the most preferred embodiments, the fixed body has an inside back support wall and the rotational member has a forward stop member affixed thereto near the front opening of the fixed body. A coil spring extends in compression between the support wall and the stop member, with the rotational member extending through such coil spring. This configuration of elements has been found to work particularly well.

In such embodiment, the fixed body has a front end at its front opening, and the stop member affixed to the rotational member is positioned thereon to engage such front end. Such engagement defines an extent of axial movement of the rotational member with respect to the fixed body sufficient to accommodate camming interaction of the first and second contact surfaces.

As the rotational member is rotated, the camming interaction of the ridge with respect to the groove causes a slight degree of axial movement of the rotational member. Such movement is against the biasing force of the spring and occurs when the ridge rides out of the groove. Reverse axial movement of the rotational member, that is, toward the fixed member, occurs under the biasing force of the spring when the ridge falls into the groove.

In preferred embodiments, the control knob affixed to the forward portion of the rotational member has a substantial radius. Such control knob is broad enough to shield completely the overflow opening from view. And, such broad control knob has a front face which is substantially entirely flat.

Such flat control knob surface allows someone to lean against the knob without discomfort or annoyance, and the broad dimension provides good mechanical advantage in operation of the control mechanism of this invention. The absence of any substantial projection also prevents certain splashing of water which occurred with certain devices of the prior art.

Because of the flatness of the knob face and the ease of operation of this invention, the control knob can be turned by those having very weak fingers or no fingers at all. This may be accomplished merely by applying the palm of the hand against the front face of the knob, pushing slightly, and turning.

The means for securing the fixed body to the tub at the overflow opening is preferably in the form of a yoke spanning the overflow opening. Such yoke is preferably integrally formed with the fixed body. Such configuration is easy to assemble with the bathtub and provides a good base member for the remaining elements of the rotary control mechanism.

BRIEF DESCRIPTION OF THE DRAWINGS

as illustrated in FIG. 1, but omitting the control knob.

DETAILED DESCRIPTIONS OF PREFERRED EMBODIMENTS

Figures 1, 10:
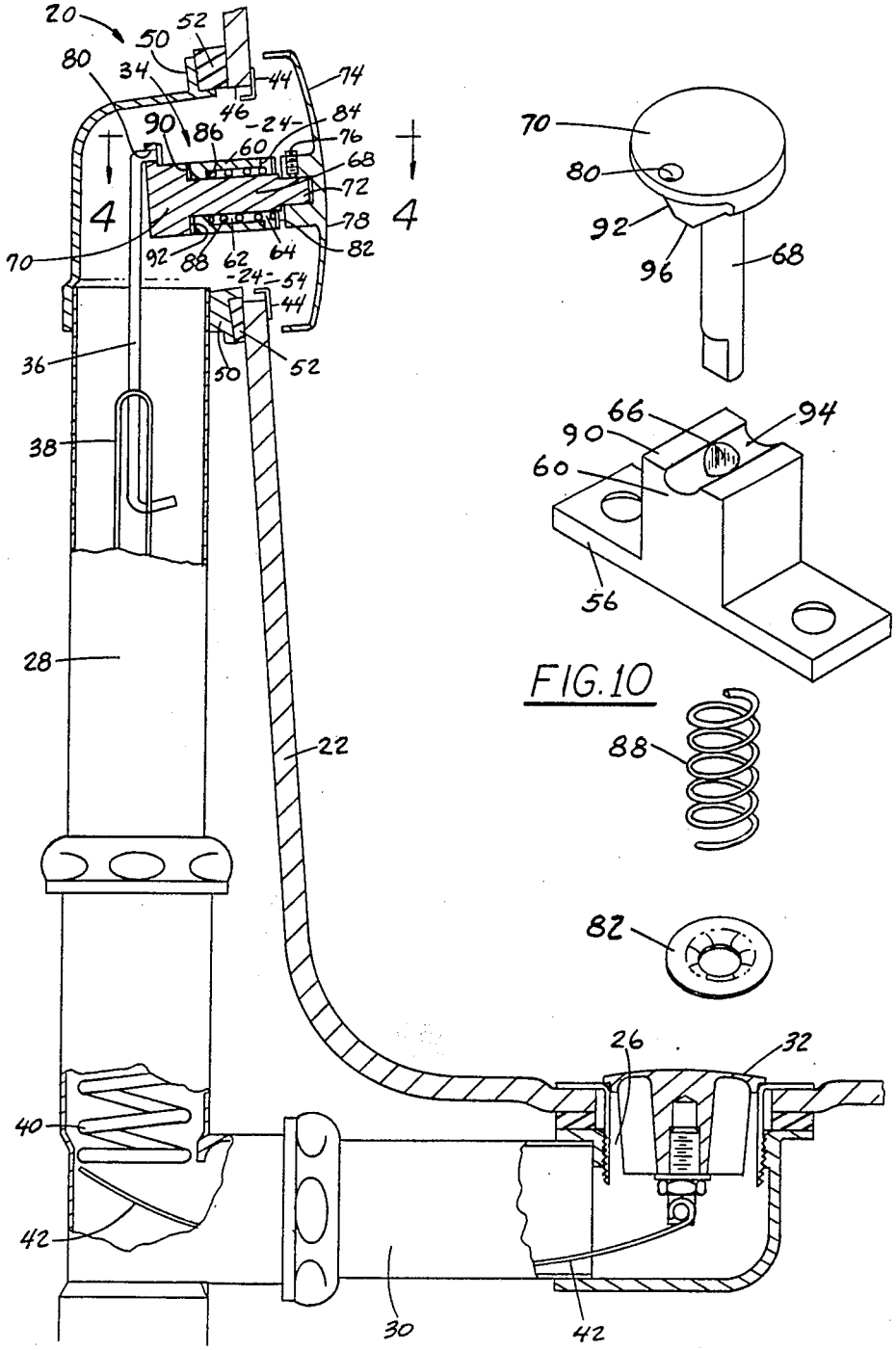
FIG. 1 is a partially cutaway, partially sectional side elevation of a bathtub drain apparatus in accordance with this invention. The sectional portions of FIG. 1 at the upper portion thereof are without background.
FIG. 10 is an enlarged fragmentary exploded perspective view showing various elements of the control mechanism.

The drawings illustrate a bathtub drain apparatus 20 in accordance with this invention. The bathtub drain apparatus 20 is secured to a bathtub 22 at its overflow opening 24 and also at its main drain opening 26.

Bathtub drain apparatus 20 includes a standpipe 28 which extends downwardly from overflow opening 24, a lateral drain pipe 30 extending from main drain opening 26 to standpipe 28, a drain plug 32 located in main drain opening 26, and a control mechanism 34 mounted at overflow opening 24.

Also included as part of bathtub drain apparatus 20 are a series of linkages extending between control mechanism 34 and drain plug 32. The linkages include link rod 36, adjustment link 38 which is adjustably connected to link rod 36, bearing coil 40 which is connected to adjustment link 38, and rocking lever arm 42 which has one end pivotably secured to drain plug 32 and the other end positioned for depression by bearing coil 40.

Vertical motion is imparted to linkage elements 36, 38 and 40 by means of control mechanism 34, as hereafter described. When such linkages are in the "down" position, bearing coil 40 rocks lever arm 42 in a counterclockwise direction (from the position shown in FIG. 1) to raise drain plug 32 and thus open main drain opening 26. When the same linkages are in the "up" position, as illustrated in FIG. 1, lever arm 42 and drain plug 32 return to the FIG. 1 position, in which main drain opening 26 is closed. The operation of rocking lever arm 42 in response to vertical motion of vertical linkages within a standpipe is well-known in the art and no further description is necessary.

Descriptions of control mechanism 34 and the upper portions of bathtub drain apparatus 20 are now given.

Figure 3:
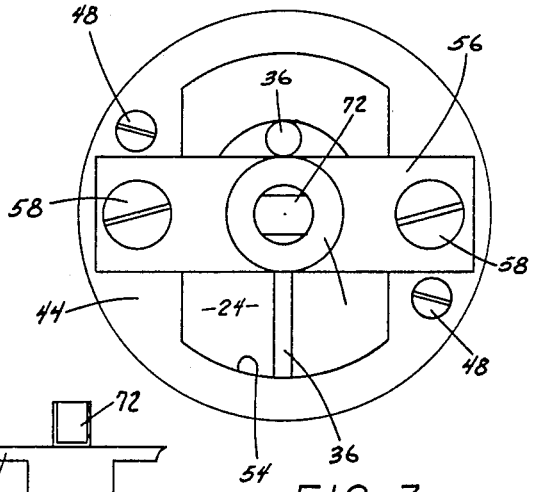
FIG. 3 is a view at the same location as FIG. 2, but with the knob removed.

FIGS. 1 and 3 show a collar 44 which engages the rim 46 of overflow opening 24. Screws 48 extend through collar 44 and into a lip 50 which surrounds the mouth of standpipe 28. A special gasket 52, sandwiched between tub rim 46 and standpipe lip 50, provides a watertight seal of lip 50 with respect to tub 22, all of such parts being drawn together by the tightening of screws 48.

Collar 44 has an opening 54 which accommodates the passage of overflow water through overflow opening 24 of bathtub 22. (In FIG. 1, collar 44. rim 46, lip 50 and gasket 52 are illustrated only at the plane of the section, their background portions being removed to allow emphasis of the principal elements of the control mechanism, hereafter described.)

As shown in FIG. 3, a yoke 56 spans overflow opening 24 and is secured to collar 44 by means of screws 58. Yoke 56 is part of a fixed body 60 which, by means of the mounting of yoke 56, is supported in a central position within tub overflow opening 24. As illustrated best in FIGS. 1 and 10, fixed body 60 has a cavity 62 extending through it from a front opening 64 to a back opening 66.

A rotational member 68, the major portion of which is a shaft, extends through cavity 62 in fixed body 60 in axial alignment with cavity 62. Rotational member 68 is free to rotate in cavity 62. Rotational member 68 has an enlarged rear portion 70 behind back opening 66 of fixed body 60, and a forward portion 72 in front of front opening 64 of fixed body 60.

Forward portion 72 of rotational member 68 is flattened to allow the removable non-rotatable attachment thereto of a control knob 74, which is locked in place on rotational member 68 by means of a set screw 76. Control knob 74 has a substantial diameter. More specifically, its diameter is sufficient such that control knob 74 shields overflow opening 24 completely from view. Yet control knob 74 has a substantially flat face 78 which may be leaned against without discomfort. The depth of control knob 74 is minimal such that it projects only slightly from the inner wall of bathtub 22, while still permitting passage of overflow water behind it.

Rear portion 70 of rotational member 68 has a non-axially positioned hole 80 which forms a linkage attachment means. Link rod 36, which has a headed upper end, is loosely engaged with rotational member 68 by extending through hole 80. as illustrated in the drawings.

By virtue of the non-axial position of attachment of link rod 36 to rotational member 68, the rotational position of rotational member 68 will determine the vertical position of link rod 36 and the other linkage elements extending in series from it, as previously described. Thus, such rotational position of attachment will determine whether drain plug 32 is open or closed. Such positioning can be changed by rotation of control knob 74 in either direction.

Affixed to rotational member 68 at a position forward of front opening 64 of fixed body 60 is a forward stop member 82. Fixed body 60 has a front end 84 at front opening 64 in position to engage the back surface of stop member 82 when rotational member 68 is moved to the rear. The positioning of stop member 82 on rotational member 68 defines the extent of axial movement of rotational member 68 with respect to fixed body 60.

Figure 4:
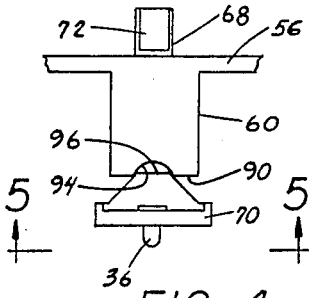
FIG. 4 is a fragmentary top view taken along section 4—4.
Figure 2:
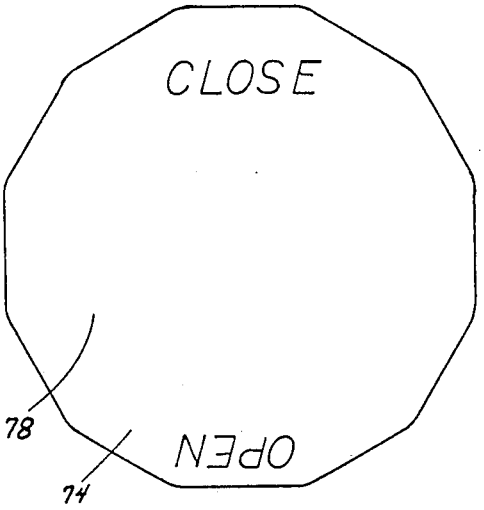
FIG. 2 is a face view of the control knob of the apparatus of FIG. 1.
Figure 5:
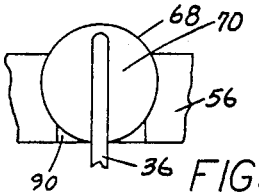
FIG. 5 is a bottom view of FIG. 4.
Figure 8:
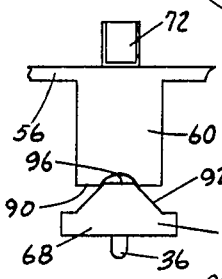
FIG. 8 is another view similar to FIG. 4, but with the apparatus rotated 180 degrees from the position of FIG. 4.

Fixed body 60 has a inside back support wall 86 which forms the back end of cavity 62. A coil spring 88 is on rotational member 68 within cavity 62. Coil spring 88 extends in compression between support wall 86 and the back surface of stop member 82. Mounted in this manner, coil spring 88 urges stop member 82 and rotational member 68 to a forward position, as illustrated in FIGS. 1, 4 and 8.

Such forward biasing of rotational member 68 causes rear portion 70 of rotational member 68 to be pressed against the back of fixed body 60. More specifically, fixed body 60 has a rearward surface 90 at back opening 66 which is referred to herein as a first contact surface. And rear portion 70 of rotational member 68 has a forward surface 92, referred to herein as a second contact surface, which is urged by coil spring 88 into camming engagement with rearward surface 90.

The different engagement characteristics of rearward surface 90 and forward surface 92 at different rotational positions of rotational member 68, with respect to fixed body 60, provide good indicators of the proper rotational positions for the fully open and fully closed conditions of the rotary bathtub drain control mechanism.

Figure 9:
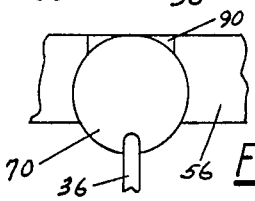
FIG. 9 is a bottom view of FIG. 8.

Rearward surface 90 forms a radially-oriented female groove 94. Forward surface 92 has a radially-oriented male ridge 96 which extends on either side of the reduced-diameter portion of rotational member 68. Ridge 96 is dimensioned to allow a slight degree of insertion thereof into groove 94. Such insertion of ridge 96 into groove 94 occurs only when rotational member 68 is rotationally positioned properly for either the fully closed position (see FIGS. 1–5) or the fully open position (see FIGS. 8 and 9).

Figure 6:
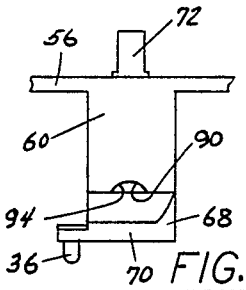
FIG. 6 is a view similar to FIG. 4, but with the control mechanism rotated 90 degrees from the position shown in FIGS. 4 and 5.
Figure 7:
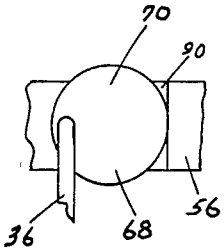
FIG. 7 is a bottom view of FIG. 6.

In any other rotational position of rotational member 68, ridge 96 will ride out of groove 94, causing rearward axial movement of rotational member 68 against the biasing force of coil spring 88 a ridge 96 and groove 94 disengage. An intermediate rotational position of rotational member 68 is illustrated in FIGS. 6–7.

Rotation in either direction from such intermediate position eventually will cause ridge 96 to drop into groove 94. Such engagement clearly indicates that either the fully open or fully closed position, as desired, has been reached. The engagement of ridge 96 with groove 94 not only serves as an indicator of proper position, but also eliminates rotational wandering or creeping which could move the device away from the desired fully open or fully closed condition.

When the fully open or fully closed position is achieved, an additional charateristic of this invention also tends to avoid movement away from the desired open or closed position. At the fully open position illustrated in FIGS. 8 and 9, the dead center or near dead center positioning of the engagement of link rod 36 with rotational member 68 effectively tends to prevent any upward force applied through link rod 36 (for example, by virtue of someone stepping of raised drain plug 32) from causing any movement whatever from the fully open position.

The direction of rotational orientation of groove 94 and ridge 96 at their positions of engagement need not be vertical, horizontal or any other particular direction. It is only important that, when groove 94 and ridge 96 are engaged, the non-axial attachment point of link rod 36 and rotating member 68 be at or near the uppermost or at or near the lowermost position.

The first and second interacting contact surfaces can be in a variety of forms other than those shown and specifically described. It is important, however, that different engagement characteristics mark different rotational positions of the rotational member with respect to a fixed body to indicate the fully open and fully closed positions.

The attachment of adjustment link 38 to link rod 36 may easily be changed to accommodate standpipes of different lengths. Other attachment means and other adjustment means may be used instead of or in addition to the means illustrated.

The elements of the apparatus of this invention may be made using materials and parts which are readily available. The entire apparatus may be assembled easily using known assembly methods.

While the principles of this invention have been described in connection with specific embodiments, it should be understood clearly that these descriptions are made only by way of example and are not intended to limit the scope of the invention.

What is claimed is:

1. A rotary bathtub drain control mechanism for mounting at a tub overflow opening, comprising:

a fixed body forming a cavity extending therethrough from a front opening to a back opening;

means for securing the fixed body to the tub at the overflow opening;

a rotational member extending in axial alignment through the cavity and having a rear portion behind the back opening and a forward portion in front of the front opening, said rotational member being axially movable to a limited extent with respect to the fixed body;

linkage attachment means on the rear portion of the rotational member in non-axial postion;

first and second cooperating contact surfaces on the fixed body and rotational member, respectively, in axially-facing contact with each other, said contact surfaces having different axially-extending engagment characteristics at different radial positions; and means axially biasing the first and second contact surfaces together at all rotational positions of the rotational member, whereby the cooperating contact surfaces serve to mark different functional positions of the rotational member with respect to the fixed body.

2. The rotary bathtub drain control mechanism of claim 1 wherein:

the fixed body has a rearward surface at the back opening forming the first contact surface; and the rear portion of the rotational member has a forward surface forming the second contact surface, the forward surface being in camming engagement with the rearward surface.

3. The rotary bathtub drain control mechanism of claim 2 wherein one of the contact surfaces forms a radially-oriented female groove and the other forms a radially-oriented male ridge engageable with the groove, whereby fully open and fully closed conditions are indicated and maintained.

4. The rotary bathtub drain control mechanism of claim 3 wherein the rearward surface forms the female groove and the forward surface forms the male ridge.

5. The rotary bathtub drain control mechanism of claim 3 wherein the rotational member may be rotated any amount in either direction.

6. The rotary bathtub drain control mechanism of claim 1 wherein the biasing means is spring means within the cavity.

7. The rotary bathtub drain control mechanism of claim 6 wherein:

the fixed body has an inside back support wall;

the rotational member has a forward stop member affixed thereto near the front opening; and the spring means is a coil spring extending in compression between the support wall and stop member.

8. The rotary bathtub drain control mechanism of claim 7 wherein the fixed body has a front end at the front opening and the stop member is positioned on the rotational member to engage the front end of the fixed body and thereby to define an extent of axial movement of the rotational member with respect to the fixed body which is sufficient to accommodate camming interaction of the first and second contact surfaces.

9. The rotary bathtub drain control mechanism of claim 6 wherein:

the fixed body has a rearward surface at the back opening forming the first contact surface; and the rear portion of the rotational member has a forward surface forming the second contact surface, the forward surface being in camming engagement with the rearward surface.

10. The rotary bathtub drain control mechanism of claim 9 wherein one of the contact surfaces forms a radially-oriented female groove and the other forms a radially-oriented male ridge engageable with the groove, whereby fully open and fully closed conditions are indicated and maintained.

11. The rotary bathtub drain control mechanism of claim 10 wherein the rearward surface forms the female groove and the forward surface forms the male ridge.

12. The rotary bathtub drain control mechanism of claim 11 wherein:

the fixed body has an inside back support wall;

the rotational member has a forward stop member affixed thereto near the front opening; and the spring means is a coil spring extending in compression between the support wall and stop member.

13. The rotary bathtub drain control mechanism of claim 12 wherein the fixed body has a front end at the front opening and the stop member is positioned on the rotational member to engage the front end of the fixed body and thereby to define an extent of axial movement of the rotational member with respect to the fixed body which is sufficient to accommodate camming interaction of the first and second contact surfaces.

14. The rotary bathtub drain control mechanism of claim 1 further including a control knob affixed to the forward portion of the rotational member, shielding the overflow opening from view, and having a front face which is substantially entirely flat.

15. The rotary bathtub drain control mechanism of claim 1 wherein the securing means is a yoke for spanning the overflow opening.

16. In bathtub drain apparatus of the type having a rotary control mechanism for mounting at a tub overflow opening and a linkage for extending from the control mechanism through a standpipe and lateral drain pipe to a drain plug at the tub drain outlet, the improvement comprising:

a fixed body forming a cavity extending therethrough from a front opening to a back opening and having a yoke for securement to the tub in position spanning the overflow opening;

a rotational member extending in axial alignment through the cavity and having a rear portion behind the back opening and a forward portion in front of the front opening, said rotational member being axially movable to a limited extent with respect to the fixed body;

means for attaching the linkage in non-axial position on the rear portion of the rotational member;

first and second cooperating contact surfaces on the fixed body and rotational member, respectively, in axially-facing contact with each other, said contact surfaces having different axially-extending engagement characteristics at different radial positions; and means axially biasing the first and second contact surfaces together at all rotational positions of the rotational member, whereby the cooperating contact surfaces serve to mark different functional positions of the rotational member with respect to the fixed body and hold the drain control in the intended position.

17. The rotary bathtub drain control mechanism of claim 16 wherein:

the fixed body has a rearward surface at the back opening forming the first contact surface; and the rear portion of the rotational member has a forward surface forming the second contact surface, the forward surface being in camming engagement with the rearward surface.

18. The rotary bathtub drain control mechanism of claim 17 wherein:

the rotational member may be rotated any amount in either direction;

one of the contact surfaces forms a radially-oriented female groove; and the other contact surface forms a radially-oriented male ridge engageable with the groove, whereby fully open and fully closed conditions are indicated and maintained.

* * * * *